US005974684A

United States Patent [19]

Steiner et al.

[11] Patent Number: 5,974,684

[45] Date of Patent: Nov. 2, 1999

[54] SUCTION DEVICE

[75] Inventors: Karl Steiner, Herbrechtingen; Hans Prinzing; Karl Gaugenmaier, both of Heidenheim, all of Germany

[73] Assignee: Voith Sulzer Papiermaschinen GmbH, Heidenheim, Germany

[21] Appl. No.: 09/019,051

[22] Filed: Feb. 5, 1998

[30] Foreign Application Priority Data

Feb. 5, 1997 [DE] Germany ..... 297 01 986 U

[51] Int. Cl.[6] ..... D21F 5/00; D06F 58/00

[52] U.S. Cl. ..... 34/115; 34/120

[58] Field of Search ..... 34/445, 446, 448, 34/451, 452, 453, 113, 114, 115, 117, 119, 120, 122, 124, 125, 634, 635; 162/206, 207, 358.1, 358.5; 226/11, 17, 84, 85, 87

[56] References Cited

U.S. PATENT DOCUMENTS

| | | | |
|---|---|---|---|
| 3,906,596 | 9/1975 | Fleissner | 34/115 |
| 5,020,242 | 6/1991 | Mayer et al. . | |
| 5,347,728 | 9/1994 | Pinter et al. | 34/117 X |
| 5,371,954 | 12/1994 | Pinter et al. | 34/117 X |
| 5,465,502 | 11/1995 | Holik et al. | 34/117 X |
| 5,640,782 | 6/1997 | Deshpande et al. | 34/115 |

FOREIGN PATENT DOCUMENTS

| | | |
|---|---|---|
| 2352102 | 12/1977 | France . |
| 4241400 | 6/1993 | Germany . |
| 4440948 | 5/1996 | Germany . |

OTHER PUBLICATIONS

Copy of a German Search Report dated Sep. 24, 1997 issued in connection with German Patent Application No. 297 01 986.4.

*Primary Examiner*—Henry Bennett
*Assistant Examiner*—Steve Gravini
*Attorney, Agent, or Firm*—Greenblum & Bernstein, P.L.C.

[57] ABSTRACT

A suction device for a machine to produce a fibrous pulp web is provided that includes a suction unit extending transverse to a web run direction over a width of the web, a vacuum source coupled to the end of the suction unit, and a plurality of suction openings distributed over the web width, where the plurality of suction openings form an entire suction zone extending over the width of the web, and where the entire suction zone includes a plurality of partial suction zones successively arranged transverse to the web run direction.

36 Claims, 7 Drawing Sheets

SUCTION DEVICE

CROSS-REFERENCE TO RELATED APPLICATION

The present invention claims the priority under 35 U.S.C. § 119 of German Application No. 297 01 986.4 filed Feb. 5, 1997.

BACKGROUND INFORMATION

1. Field of the Invention

The invention relates to a suction device, in particular a suction box or a suction roll, for a machine that manufactures or processes a fibrous pulp web, such as a paper web.

2. Discussion of Background Information

A suction device, in particular a suction device for a suction box or a suction roll, that extends in a direction transverse to the web run direction in a machine for manufacturing a fibrous pulp web is known, for example, from DE 44 40 948. The suction device disclosed in DE 44 40 948 is designed as a suction roll, with a roll sleeve that is mounted on a pivot, that is perforated, and that has a vacuum connection to create a vacuum in the roll interior. The vacuum region of this suction zone expands to the roll perforations. The suction zone extends transversely over the width of the web, along the longitudinal axis of the suction roll. A displaceable partition wall is designed in the interior of the roll, along the longitudinal axis of the roll, which allows the division of the suction zone into a suctioned section and a section that is not suctioned.

Such a suction roll is used, for example, in a paper manufacturing machine where a moist paper web must be transferred from one machine section (e.g. a press section) to the subsequent machine section (e.g. a drying section). When feeding the web into the paper machine, initially only a narrow peripheral strip of the web runs over the suction roll. Accordingly, only a small portion of the suction zone is connected to the vacuum source. Thereafter, as one gradually feeds the web into the machine and the strip widens (up to the full width of the web in the end), the width of the suction zone is correspondingly extended through movement of the displaceable partition wall. By expanding the suction zone in coordination with the increasing width of the web being fed into the processing machine, the suctioning of air through perforations that have not yet been covered by the paper web can be avoided. Otherwise, a markedly greater amount of energy would be required to create the vacuum in the suction zone.

A disadvantage of such a known construction is that contaminant can be deposited on the displaceable partition wall, and under certain conditions this may result in machine malfunctions. It is also possible that wear can lead to leakage losses. With very wide paper machines (such as 10 m in width, for example) it is also difficult to dependably design the mechanism, including the driving mechanism, for the displaceable partition wall.

SUMMARY OF THE INVENTION

To improve the design of a suction device, in particular a suction device for a suction box or a suction roll in a machine for processing a fibrous pulp web, the length of an effective suction zone transverse to web run direction can be varied with a maximum dependability and a minimum expenditure with a suction device having a number of suction openings distributed over the web width, which can be connected to a vacuum source, and which together form a suction zone, where the suction zone is divided in a number of partial suction zones beginning at one end of the suction device and successively arranged (i.e., side-by-side). The suction device according to the present invention is less sensitive to potential contaminant deposits. Leakage losses also can be minimized, if in accordance with the invention, the partial zones of the suction zone, which runs in a direction transverse to the web run direction, are relatively small in size. Additionally, numerous embodiments of the invention do not have a driving element that extends over the entire length of the suction device.

The present invention provides a suction device for a machine to produce or process a fibrous pulp web that includes a suction unit extending transverse to a web run direction and over a width of the web, a vacuum source coupled to an end of the suction unit, and a plurality of suction openings distributed over the web width, where the plurality of suction openings adapted to be coupled to the vacuum source to form an entire suction zone extending over the web width, and where the entire suction zone includes a plurality of partial suction zones successively arranged transverse to the web run direction. The valve assembly may individually connect a vacuum to each of the plurality of partial suction zones. Moreover, each of the plurality of partial suction zones may be selectively isolatable (i.e., closeable) from the vacuum source Further, the suction device may include each of the suction openings being associated with a respective one of the plurality of partial suction zones. The suction device also may include the valve assembly being arranged within the suction device and directly controlling application of the vacuum to each of the plurality of partial suction zones.

The valve assembly of the suction device may include a plurality of valve devices, with each valve device including a sealing plate, a piston fastened to the sealing plate, and an operating cylinder for moving the piston, where radial movement of the piston causes the sealing plate to slidably control the application of the vacuum. Alternatively, the valve assembly may include a longitudinally displaceable plate extending through the suction device that has an opening corresponding to each of the partial suction zones, where longitudinal displacement of the plate controls the application of the vacuum. Moreover, the valve assembly of the suction device may include a pipe-like rotating valve gate that has a longitudinal axis extending through the suction device and an opening corresponding to each of the plurality of partial suction zones, where the longitudinal axis of the valve gate is substantially parallel to the longitudinal axis of the suction device, and where rotation of the valve gate about its longitudinal axis controls the application of the vacuum.

The suction device may have a first end and a second end, with the first end being adjacent to the continuously-suctioned partial suction zone, and where the valve assembly includes a first roll adjacent to the first end, a second roll adjacent to the second end, and a circulating element looped over the first roll and the second roll, where the circulating element is partially open and partially closed and has an opening corresponding to each of the partial suction zones, and where rotation of the circulating element about the two rolls controls the application of the vacuum. The circulating element may be continuous belt, or alternatively a continuous chain.

The valve assembly of the suction device may include a plurality of valve devices, where a number of the plurality of valve devices are arranged within the suction device and a number of the plurality of valve devices are arranged outside the suction device. Moreover, the suction control unit may include a plurality of supply lines and a plurality of valve devices, where each of the valve devices individually controls application of the vacuum to each of the partial suction zones via each of the plurality of supply lines. The plurality of valve devices may be positioned outside of the suction device.

According to another aspect of the present invention, the valve assembly may include a slide valve, and the slide valve may include a plurality of movable valve gates, a spring for biasing the movable valve gates, and a cam shaft, where rotation of the cam shaft controls application of the vacuum to the partial suction zones. Alternatively, the valve assembly, may include a distribution cylinder connected with the vacuum source and that has a longitudinal axis, a shaft arranged along the longitudinal axis of the distribution cylinder, and an axially displaceable piston arranged on the shaft, where displacement of the piston controls the application of the vacuum.

The suction device of the present invention may include a plurality of radially displaceable partition walls disposed within the suction device to separate the plurality of partial suction zones, where radial displacement of individual partition walls controls the application of the vacuum. This device may further include a camshaft that individually radially displaces the partition walls. The suction device of the present invention may be a stationary suction box. Alternatively, the suction box of the present invention may be arranged inside a perforated, rotatable roll sleeve having an inside surface. This suction box may include a plurality of intermediate partitions that define the plurality of partial suction zones and a plurality of flexible sealing elements that form sealing gaps with the interior surface of the roll sleeve.

According to the present invention, the suction device may have a leading end, and the continuously suctioned partial suction zone may be adjacent to the leading end, such that vacuum can be sequentially applied to the plurality of partial suction zones, beginning with the partial suction zone adjacent to the continuously-suctioned partial suction zone. Furthermore, this suction device may include a high vacuum source and a low vacuum source connected to a low vacuum region, and a longitudinal seal, where the continuously-suctioned partial suction zone extends over the width of the entire suction zone in the web run direction and connects with the high vacuum source, where the entire suction zone includes a high vacuum region, a low vacuum region and the continuously-suctioned vacuum region, where the low vacuum region is arranged behind the high vacuum region in the web run direction, where the longitudinal seal is arranged transverse to the web run direction to separate the high vacuum region and the low vacuum region, and where the high vacuum region includes at least a number of the plurality of partial suction zones which can be sequentially connected with the high vacuum source. The low-vacuum region may include a number of partial suction zones which can be sequentially connected with the low vacuum source. Moreover, the number of partial suction zones in the high-vacuum region may exceed the number of partial suction zones in the low pressure region.

The suction device may include a rear partial suction zone adjacent to the second end of the suction device, where the rear partial suction zone extends over the width of the entire suction zone in the web run direction. This suction device may include the rear partial suction zone being connected with the low-vacuum source. Alternatively, the rear partial suction zone may be connected with the high-vacuum source. The fibrous pulp web processed by the suction device may be a paper web.

According to another aspect of the invention, a suction device of a suction roll composed of a rotatable roll sleeve having an interior surface for a machine to process a fibrous pulp web is provided that includes a suction unit extending transverse to a web run direction over a width of the web, a vacuum source coupled to an end of the suction unit, a plurality of suction openings distributed over a web width, a distribution cylinder formed within the suction unit, an intermediate partition comprising a piston arranged within in the distribution cylinder, and a portion of the intermediate partition being composed of a finely perforated sealing body to abuttingly seal the intermediate partition against an interior surface of the rotatable roll sleeve, where the plurality of suction openings are adapted to be coupled to the vacuum source to form an entire suction zone extending over the width of the web, and where the entire suction zone is divided into two partial suction zones successively arranged transverse to the web run direction. The fibrous pulp web may be a paper web.

According to yet another aspect of the present invention, a suction device of a suction roll composed of a rotatable roll sleeve having an interior surface for a machine to process a fibrous pulp web is provided that includes a vacuum source, a plurality of suction openings extending transverse to a web run direction, a continuously-suctioned partial suction zone extending in a direction transverse to the web run direction where the continuously-suctioned partial suction zone communicating with the plurality of suction openings, a plurality of partial suction zones adjacent to the continuously-suctioned partial suction zone extending transverse to the web run direction where the plurality of partial suction zones communicate with the plurality of suction openings, and a suction control mechanism that controls sequential application of a vacuum from the vacuum source to the plurality of partial suction zones where the continuously-suctioned partial suction zone and the plurality of partial suction zones forming an entire suction zone having a width in the web run direction and a length extending the width of the web. Each of the plurality of partial suction zones may be selectively isolated from the vacuum. Moreover, each of the plurality of suction openings may be associated with a respective one of the plurality of partial suction zones.

Further, the aforementioned and following characteristic features of the present invention can be used not only in the described combinations, but also in other combinations or alone, without departing from the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawings by way of non-limiting examples of preferred embodiments of the present invention, wherein the same reference numerals represent similar parts throughout the drawings, and wherein.

DETAILED DESCRIPTION OF THE INVENTION

Figure 1:
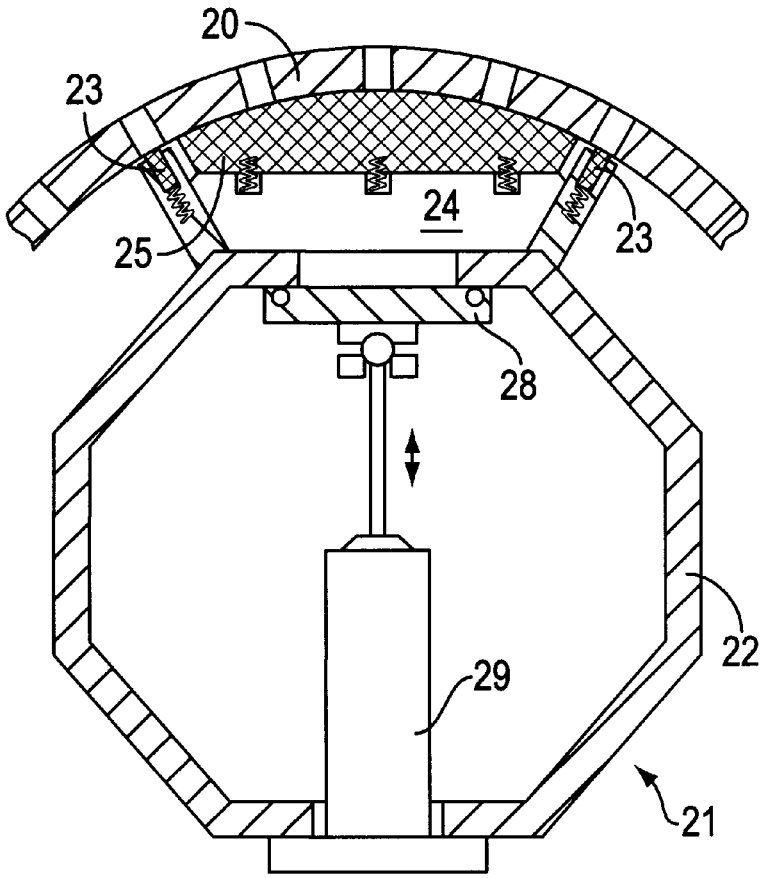
FIG. 1 is a partial cross-sectional view of an aspect of the invention in a suction roll.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

In the Figures, a rotatable and perforated suction roll sleeve 20 are illustrated, as is a stationary suction box 21 of a different construction. However, the suction roll sleeve is not a necessary component of certain of the embodiments of the suction device, as the invention can be embodied in a stationary suction box over which glides a paper machine sieve or paper machine felt, for example. In such a construction, a slit or perforated stationary suction plate can be designed on the stationary suction box, in place of the rotating suction roll sleeve.

Stationary suction device 21 of FIG. 1 includes a stay pipe (i.e., a stationary pipe) 22, which may be round or polygonal in cross-section, and which supports longitudinal sealing strips 23, as well as numerous intermediate partitions 24 (see also FIG. 2) with peripheral sealing strips 25. Sealing strips 23 and 25 are gently pressed against the interior surface of roll sleeve 20 with pressure springs.

The interior of the stay pipe 22 is connected to a vacuum source in a manner which is known in the art. Between every two intermediate partitions 24, there are openings 26, 27, so that a partial vacuum extends to the orifices of the suction roll sleeve. According to the embodiment of the invention in FIG. 2, an opening 26 is always open on one end of the roll, so that its corresponding partial zone 52, of the entire suction zone of the suction device, may be continuously suctioned. Other openings 27, on the other hand, can be sealed with the aid of individually controlled valve gates.

In FIG. 1, individual valve gate 28 is designed as a sliding head. Valve gate 28 includes a sealing plate fastened to the piston rod of operating cylinder 29, such that cylinder 29 is fixedly attached to stay pipe 22.

Figure 2:
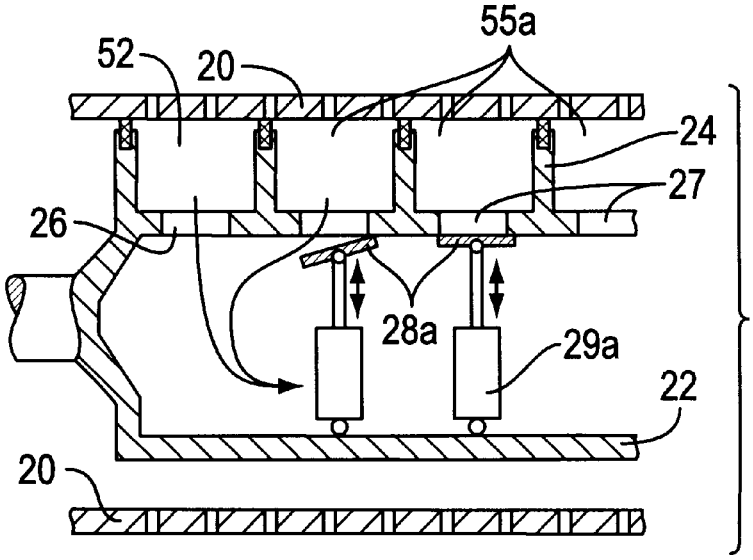
FIG. 2 is a longitudinal view of another aspect of the invention in a suction roll.
Figure 3:
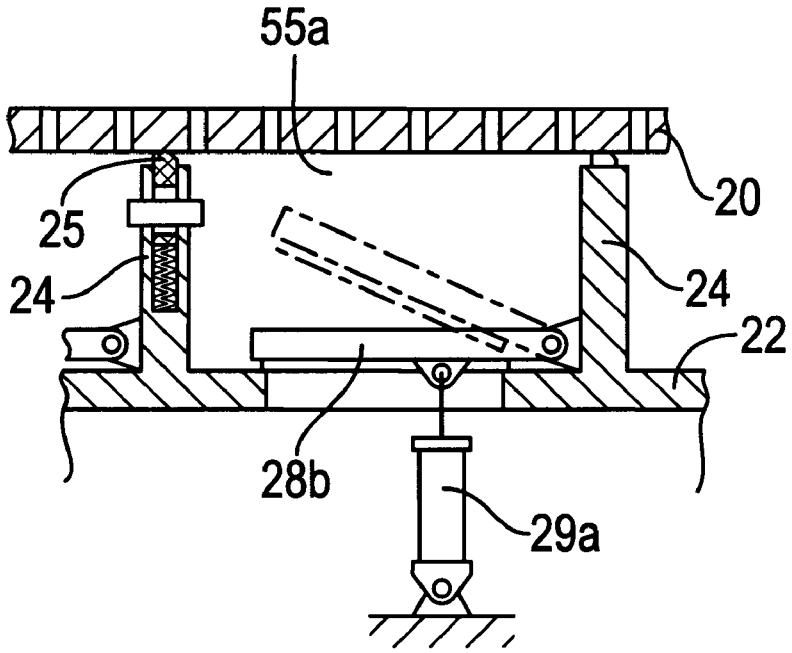
FIG. 3 is a longitudinal view of yet another aspect of the invention in a suction roll.

In FIGS. 2 and 3, moveable valve gates 28*a*, 28*b* are designed as rotating flaps. Operating cylinders 29*a* are also rotatable. In FIG. 2, the flaps are hingedly attached on the inside of the stay pipe 22. In FIG. 3, on the other hand, the flaps are hingedly attached the outside of stay pipe 22, or on the side of each of the intermediate partitions 24.

Figure 4:
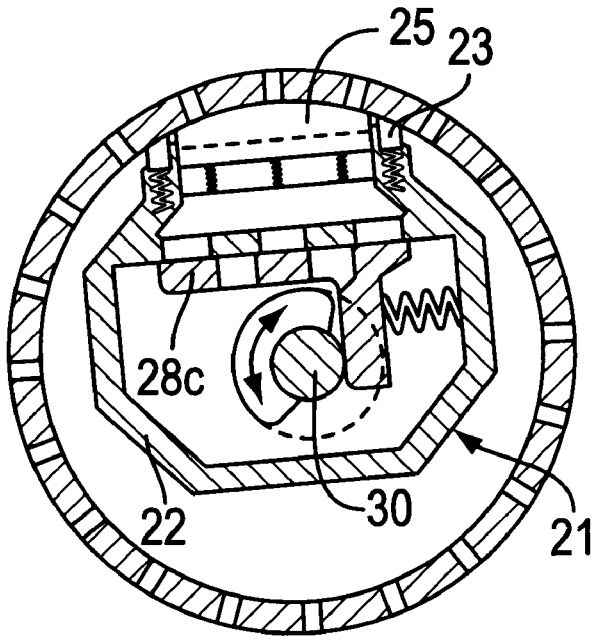
FIG. 4 is a cross-sectional view of another aspect of the invention in a suction roll.

In FIG. 4, each of the individually moveable valve gates 28*c* is designed as a slide valve (depicted in the position "closed"). While in FIGS. 1–3 operating cylinders 29, 29*a* drive valve gates 28, 28*a*, 28*b* sequentially into the opened position, the sequential opening of slide valves 28*c* in FIG. 4 proceeds by means rotation of camshaft 30.

Figure 5:
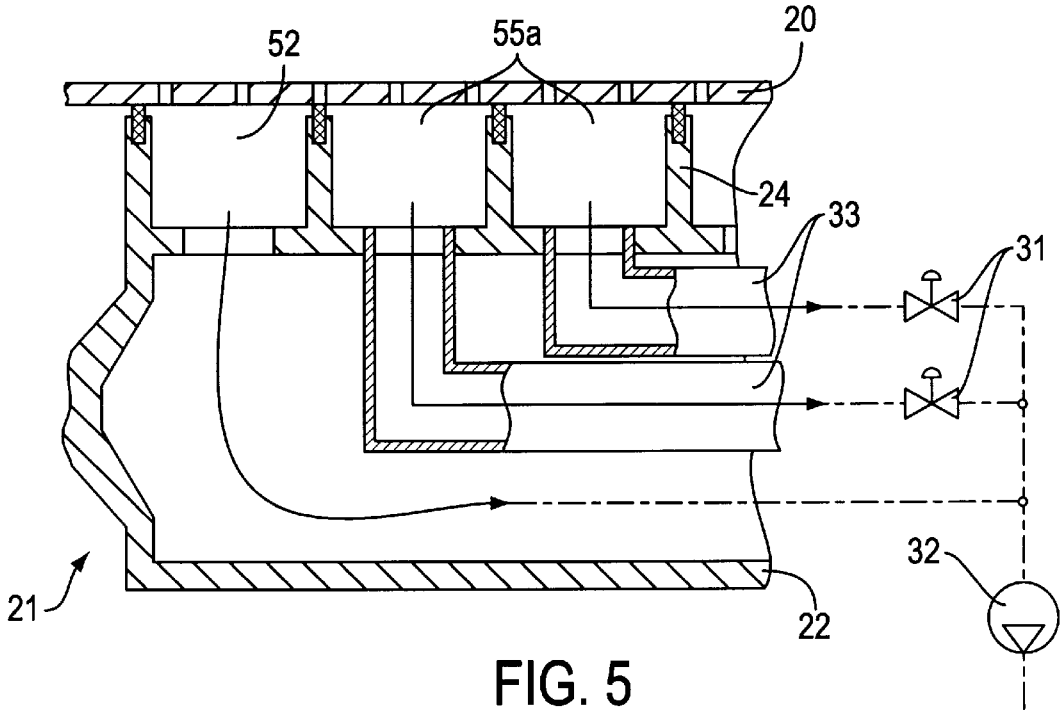
FIG. 5 is a longitudinal view of still another aspect of the invention in a suction roll.

In FIG. 5, valves 31 are designed for each partial zone of the entire suction zone of the suction device (except for the first partial zone 52). Each of these valves 32 is connected to a vacuum source 32, via a supply line 33, to the corresponding partial suction zone.

Figure 6:
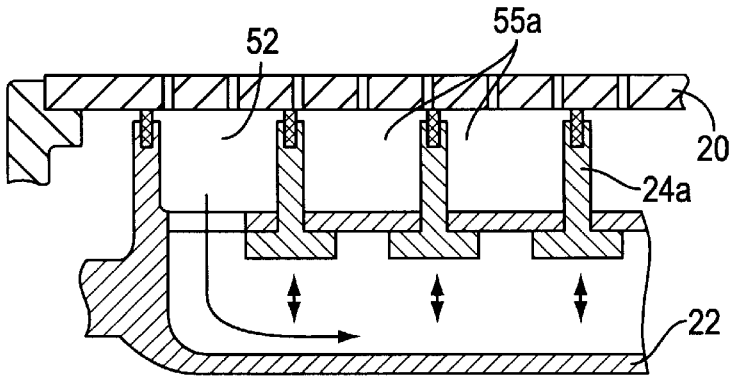
FIG. 6 is a longitudinal view of another aspect of the invention in a suction roll.

In FIG. 6, the partial connection zones to a vacuum source are separated from one another by radially displaceable intermediate partitions 24*a*. These intermediate partitions 24*a* can be successively retracted or removed in a radially inward direction from their point of contact with the interior surface of suction roll sleeve 20, so that these intermediate partitions lose their partitioning function. In this process, the length of the entire active suction zone is extended step-by-step.

Figure 7:
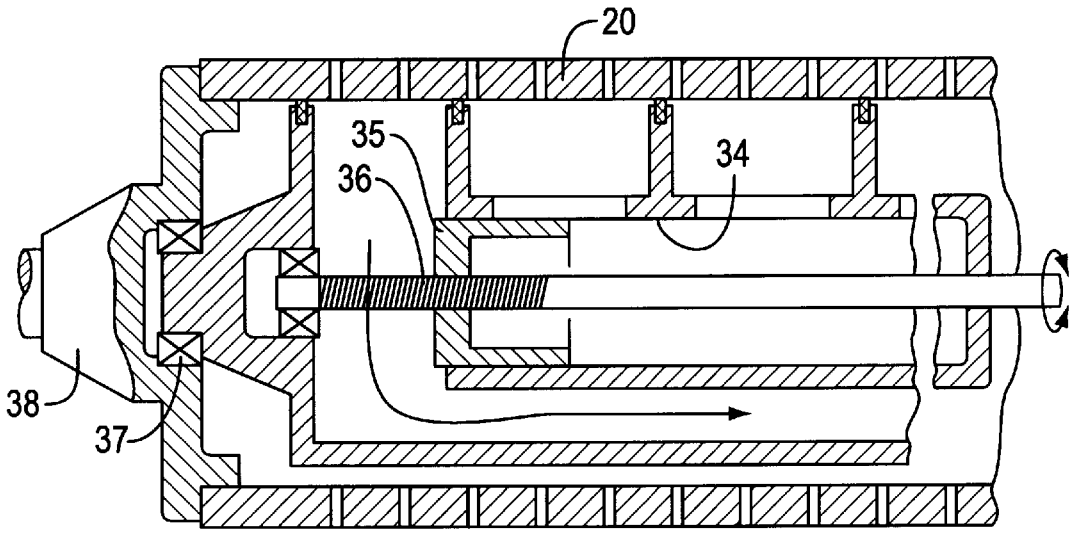
FIG. 7 is a longitudinal view of yet another aspect of the invention in a suction roll.

In FIG. 7, distribution cylinder 34 is designed within the stationary suction box 21. Distribution cylinder 34 has one opening per partial suction zone, and it is open at one end to the continuously suctioned partial zone while being sealed at its other end. In distribution cylinder 34 there is an axially displaceable piston 35, which is driven, for example, by a spindle 36. If this piston 35, as seen in FIG. 7, slides to the right, it sequentially connects one partial suction zone after another with the vacuum source.

FIG. 7 also illustrates that stationary suction box 21 may be positioned in a conventional manner in the suction roll with a rolling bearing 37 in a rotating roll pin 38 of the suction roll. It should be understood for this and the other embodiments of the suction box that roll sleeve 20 is rotatably positioned on the stationary suction box 21, which is attached to the machine frame.

Figure 8:
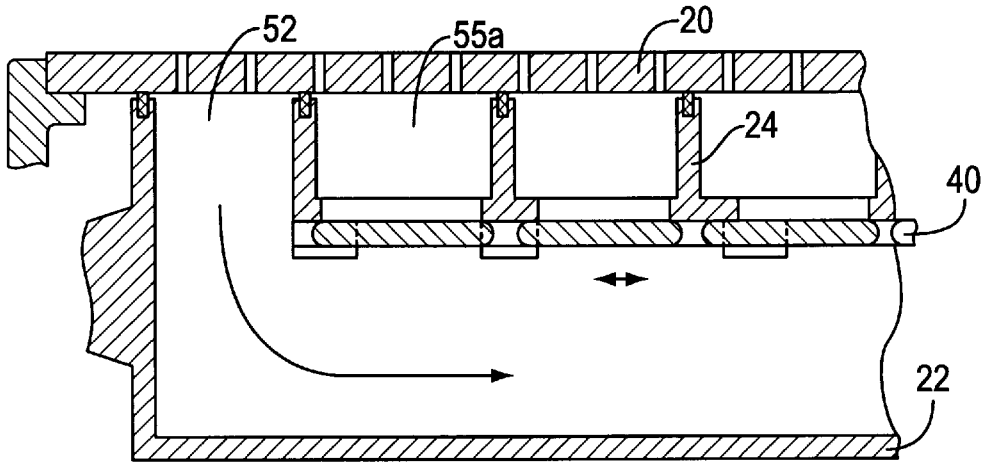
FIG. 8 is a longitudinal view of another aspect of the invention in a suction roll.
Figure 9:
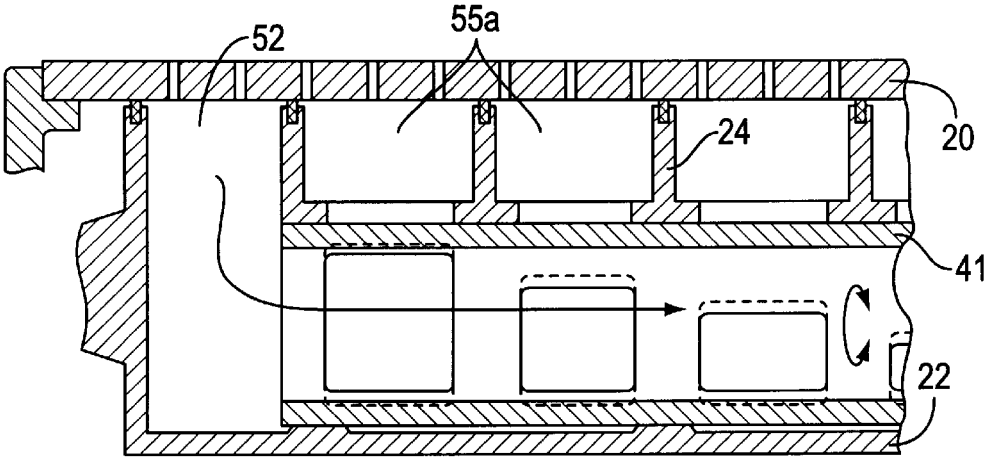
FIG. 9 is a longitudinal view of still another aspect of the invention in a suction roll.

FIGS. 8 and 9 illustrate that all of the valve devices can be constructed by a jointly moveable valve gate 40 or 41, which extends longitudinally through the suction device and has an opening for each partial suction zone 55*a* . In FIG. 8, the jointly moveable valve gate is designed as a longitudinally displaceable plate 40. On the other hand, in FIG. 9, the jointly moveable valve gate is designed as a pipe-like rotor 41. In both embodiments, the arrangement is such that (assuming partial suction zone 52 is continuously connected with the vacuum source) one partial suction zone 55*a* after another may be sequentially suctioned during operation.

Figure 10:
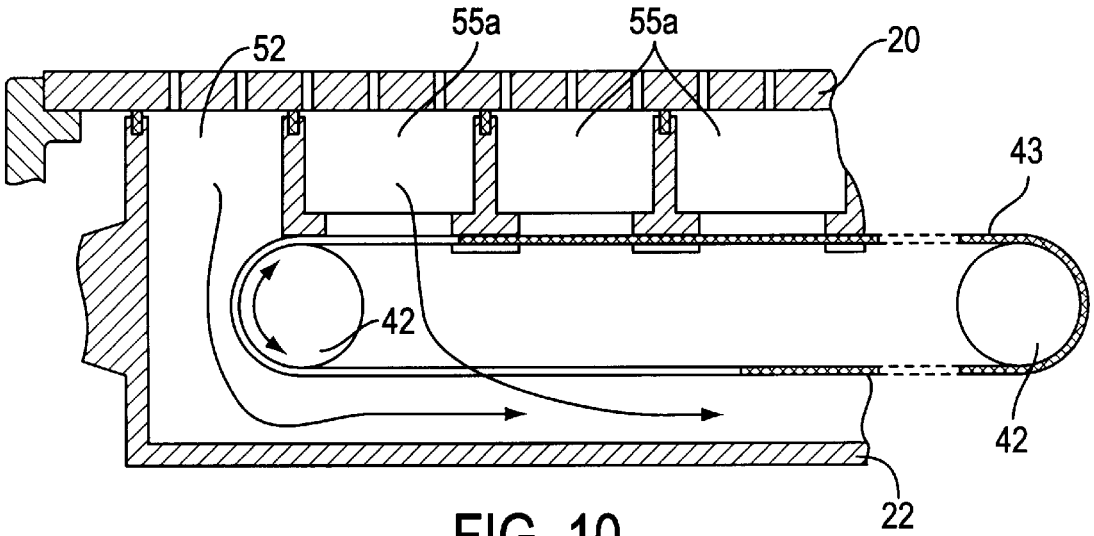
FIG. 10 is a longitudinal view of another aspect of the invention in a suction roll.

In FIG. 10, such sequential suction of partial suction zones is achieved by means of a continuous element that is looped over two rolls 42. The continuous element is illustrated as a continuous belt 43 in FIG. 10. However, the use of a continuous chain would also be possible. The looping element is partially open and partially closed, so that the partial suction zones 55*a* are connected one after the other to the vacuum source during a rotation around rolls 42.

Figure 11:
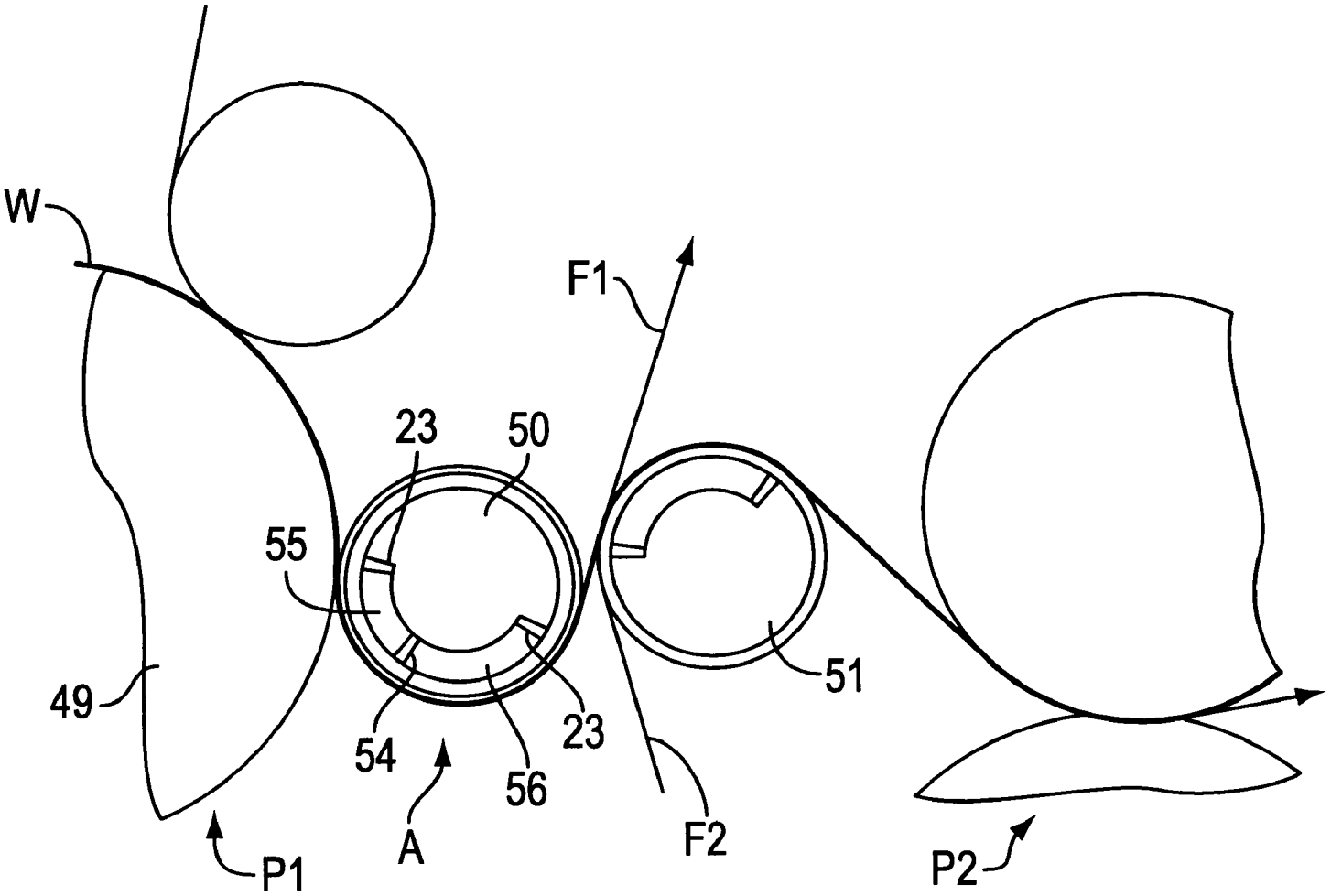
FIG. 11 is a partial view of a press section.

FIG. 11 illustrates an aspect of the invention for a suction roll 50 within the press section of a web manufacturing machine. a fibrous web W (shown with a broad solid line) that needs to be drained runs over a conventionally-felted press P1, and then together with felt F1 runs over suction roll 50. Thereafter, on the surface of a second suction roll 51, fibrous web W comes in contact with a second felt F2, which guides the web through a further press P2.

Figure 12:
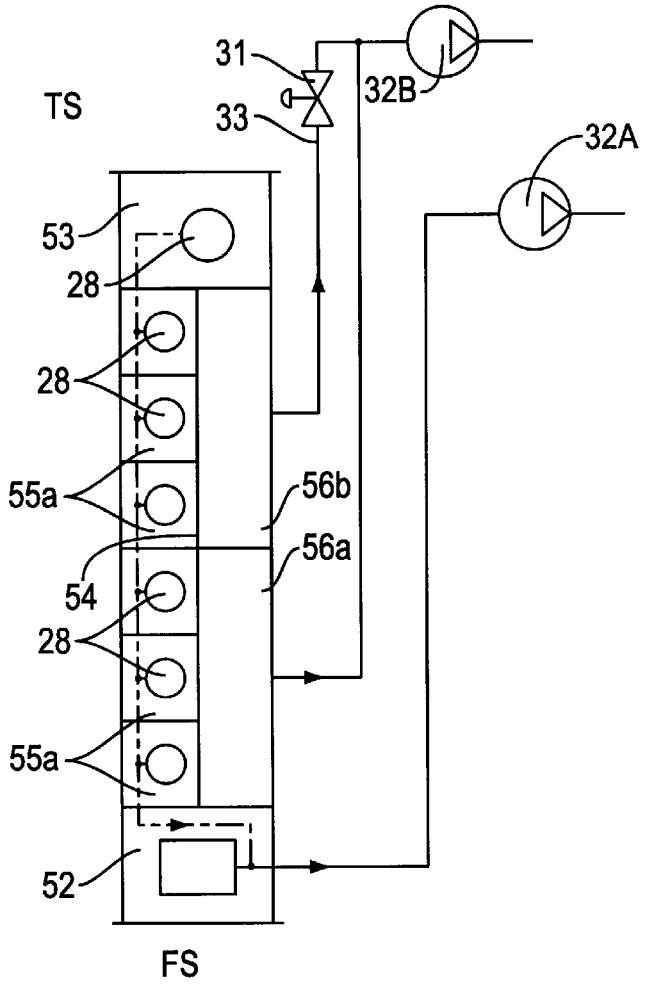
FIG. 12 is a schematic view of the suction device of a suction roll of FIG. 11 in the direction of arrow a in FIG. 11.

The partitioning of the entire suction zone of the suction device of roll 50 is schematically depicted in FIG. 12.

FS-partial suction zone 52, which is suctioned continuously via high-vacuum source 32A, is designed on the leading end FS of the roll, for the transfer of the peripheral strip of the fibrous web. The vacuum of FS-partial suction zone 52 extends in the web run direction over the width of the suction zone. TS-partial suction zone 53 is designed at the rear end TS of the roll, and this partial suction zone also extends in the web run direction over the entire width of the suction zone. With the aid of TS-partial suction zone 53, the rear periphery of the paper web is held securely on felt F1.

Longitudinal seal 54 is positioned between the FS and TS partial suction zones 52, 53, and longitudinal seal 54 divides the suction zone in a high-vacuum region 55 and in a low-vacuum region 56, as shown in FIG. 11. Felt F1 runs together with fibrous web W over the high-vacuum region 55. High vacuum region 55 is located where press roll 49 and suction roll 50 are in closest proximity. a relatively high vacuum is necessary to remove web W from press roll 49 with certainty. However, a lower vacuum is needed in subsequent low-pressure area 56, because in this region, web W must only counteract the centrifugal force of felt F1.

As previously described in FIGS. 1–10, high-vacuum region 55 is partitioned into numerous partial suction zones 55*a* , which lie behind one another transverse to web run direction, and which can be connected successively to high-vacuum source 32A. The partial suction zones are individually assigned a valve device (such as valve device 28, 29 of FIG. 1) as is TS-partial suction zone 53. Deviating from what is shown in FIG. 12, it also should be understood that the size of partial suction zones 55*a* transverse to web run direction can vary.

In FIG. 2, the low-vacuum area 56 is also partitioned, but into a fewer number of partial suction zones 56*a,* 56*b* than in the high-vacuum area. Each partial vacuum zones 56*a,* 56*b* may be connected to low-vacuum source 32B via a supply line 33, and via an externally positioned valve 31. However, as depicted in FIG. 12, the leading end of the partial suction zone 56*a* is continuously connected with low-vacuum source 32B.

Figure 13:
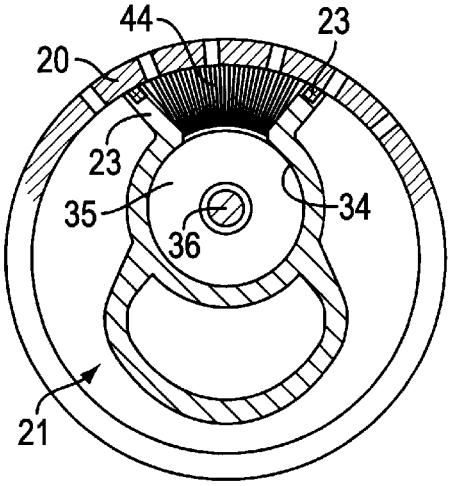
FIG. 13 is a cross-sectional view of another aspect of the invention in a suction roll.

The aspect of the invention depicted in FIG. 13 is similar in design with that shown in FIG. 7, when observed in a longitudinal direction. Axially displaceable piston 35 is arranged within a distribution cylinder 34, which is arranged within stationary suction box 21. In contrast with FIG. 7, the intermediate partitions 24 of FIG. 11 have been removed. Instead, a segment of the partition of the distribution cylinder is designed as a finely perforated sealing body 44, which lies against the inside of the rotatable roll sleeve 20. Axially displaceable piston 35 may form a border between two partial suction zones, of which only one is suctioned. By sliding piston 35, the length of this suctioned partial suction zone is continuously extended up to the entire web width.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

What is claimed:

1. A suction device for a machine to produce or process a fibrous pulp web, comprising a suction unit extending transverse to a web run direction and over a width of the web;

a vacuum source coupled to an end of the suction unit;

a plurality of suction openings distributed over the web width;

the plurality of suction openings adapted to be coupled to the vacuum source to form an entire suction zone having a length extending over the web width; and the entire suction zone comprising a plurality of partial suction zones successively arranged transverse to the web run direction, which are sequentially connectable to the vacuum source such that the length of the entire suction zone is extended.

2. The suction device of claim 1, comprising a valve assembly that individually connects a vacuum to each of the plurality of partial suction zones.

3. The suction device according to claim 1, further comprising each of the plurality of partial suction zones being selectively isolatable from the vacuum source.

4. The suction device according to claim 1, further comprising each of the plurality of suction openings being associated with a respective one of the plurality of partial suction zones.

5. The suction device of claim 2, further comprising the valve assembly being arranged within the suction device and directly controlling application of the vacuum to each of the plurality of partial suction zones.

6. The suction device of claim 5, the valve assembly comprising a plurality of valve devices, each of the plurality of valve devices including:

a sealing plate;

a piston fastened to the sealing plate; and an operating cylinder for moving the piston, wherein radial movement of the piston causes the sealing plate to slidably control the application of the vacuum.

7. The suction device of claim 5, the valve assembly comprising:

a longitudinally displaceable plate extending through the suction device and having an opening corresponding to each of the plurality of partial suction zones, wherein longitudinal displacement of the plate controls the application of the vacuum.

8. The suction device of claim 5, the valve assembly comprising:

a pipe-like rotating valve gate having a longitudinal axis extending through the suction device and having an opening corresponding to each of the plurality of partial suction zones; and the longitudinal axis of the valve gate being substantially parallel to the longitudinal axis of the suction device, wherein rotation of the valve gate about its longitudinal axis controls the application of the vacuum.

9. The suction device of claim 5, the suction device having a first end and a second end, the first end being adjacent to the continuously-suctioned partial suction zone, the valve assembly comprising:

a first roll adjacent to the first end;

a second roll adjacent to the second end; and a circulating element looped over the first roll and the second roll;

the circulating element being partially open and partially closed and having an opening corresponding to each of the plurality of partial suction zones, wherein rotation of the circulating element about the two rolls controls the application of the vacuum.

10. The suction device of claim 9, the circulating element comprising a continuous belt.

11. The suction device of claim 9, the circulating element comprising a continuous chain.

12. The suction device according to claim 2, the valve assembly comprising:

a plurality of valve devices, the plurality of valve devices being arranged within the suction device and outside the suction device.

13. The suction device of claim 1, the suction control unit comprising:

a plurality of supply lines; and a plurality of valve devices, each of the plurality of valve devices individually controlling application of a vacuum to each of the plurality of partial suction zones via each of the plurality of supply lines.

14. The suction device of claim 13, the plurality of valve devices comprising a plurality of remotely positioned valve devices outside of the suction device.

15. The suction device according to claim 5, the valve assembly comprising a slide valve, the slide valve including:

a plurality of movable valve gates;

a spring for biasing the movable valve gates; and a cam shaft, wherein rotation of the cam shaft controls application of the vacuum to the plurality of partial suction zones.

16. The suction device according to claim 5, the valve assembly comprising:

a distribution cylinder connected with the vacuum source and having a longitudinal axis;

a shaft arranged along the longitudinal axis of the distribution cylinder; and an axially displaceable piston arranged on the shaft, wherein displacement of the piston controls the application of the vacuum.

17. The suction device according to claim 1, comprising:

a plurality of radially displaceable partition walls being disposed within the suction device to separate the plurality of partial suction zones, wherein individual radial displacement of each of the partition walls controls the application of the vacuum.

18. The suction device according to claim 17, further comprising a camshaft that individually radially displaces the plurality of partition walls.

19. The suction device according to claim 1, the suction device comprising a stationary suction box.

20. The suction device according to claim 19, the stationary suction box being arranged inside a perforated, rotatable roll sleeve having an inside surface.

21. The suction device according to claim 20, comprising:

a plurality of intermediate partitions that define the plurality of partial suction zones; and a plurality of flexible sealing elements that form sealing gaps with the interior surface of the roll sleeve.

22. The suction device according to claim 5, the suction device including a leading end; and the continuously-suctioned partial suction zone being adjacent to the leading end, wherein the vacuum can be sequentially applied to the plurality of partial suction zones, beginning with the partial suction zone adjacent to the continuously-suctioned partial suction zone.

23. The suction device according to claim 22, the vacuum source including a high vacuum source, further comprising:

a low vacuum source connected to a low vacuum region;

a longitudinal seal;

the continuously-suctioned partial suction zone extending over the width of the entire suction zone in the web run direction and being connecting with the high vacuum source;

the entire suction zone including a high vacuum region, the low vacuum region arranged behind the high vacuum region in the web run direction, and the continuously-suctioned partial zone; and the longitudinal seal being arranged transverse to the web run direction to separate the high vacuum region and the low vacuum region, wherein the high vacuum region includes at least a number of the plurality of partial suction zones which can be sequentially connected with the high vacuum source.

24. The suction device according to claim 23, the low-vacuum region comprising a number of the plurality of partial suction zones which can be sequentially connected with the low vacuum source.

25. The suction device according to claim 24, wherein the number of partial suction zones in the high-vacuum region exceeds the number of partial suction zones in the low pressure region.

26. The suction device according to claim 23, comprising:

a rear partial suction zone adjacent to the second end of the suction device, wherein the rear partial suction zone extends over the width of the entire suction zone in the web run direction.

27. The suction according to claim 26, further comprising the rear partial suction zone being connected with the low-vacuum source.

28. The suction device according to claim 26, further comprising the rear partial suction zone being connected with the high-vacuum source.

29. The suction device according to claim 1, the fibrous pulp web comprising a paper web.

30. The suction device of claim 1, wherein the plurality of suction zones are sequentially connectable to the vacuum source such that the length of the entire suction zone is extended step-by-step.

31. A suction device of a suction roll composed of a rotatable roll sleeve having an interior surface for a machine to process a fibrous pulp web, comprising:

a suction unit extending transverse to a web run direction and over a width of the web;

a vacuum source coupled to an end of the suction unit;

a plurality of suction openings distributed over the web width;

the plurality of suction openings adapted to be coupled to the vacuum source to form an entire suction zone having a length extending over the web width;

the entire suction zone being divided into two partial suction zones successively arranged transverse to the web run direction, which are sequentially connectable to the vacuum source such that the length of the entire suction zone is extended;

a distribution cylinder arranged within the suction unit;

an intermediate partition comprising a piston arranged within in the distribution cylinder; and a portion of the intermediate partition being composed of a finely perforated sealing body to abuttingly seal the intermediate partition against an interior surface of the rotatable roll sleeve.

32. The suction device according to claim 31, the fibrous pulp web comprising a paper web.

33. The suction device of claim 31, wherein the plurality of suction zones are sequentially connectable to the vacuum source such that the length of the entire suction zone is extended step-by-step.

34. A suction device of a suction roll composed of a rotatable roll sleeve having an interior surface for a machine to process a fibrous pulp web, comprising:

a vacuum source;

a plurality of suction openings extending transverse to a web run direction;

a continuously-suctioned partial suction zone extending in a direction transverse to the web run direction;

the continuously-suctioned partial suction zone communicating with the plurality of suction openings;

a plurality of partial suction zones adjacent to the continuously-suctioned partial suction zone extending transverse to the web run direction;

the plurality of partial suction zones communicate with the plurality of suction openings;

a suction control mechanism that controls sequential application of a vacuum from the vacuum source to the plurality of partial suction zones; and the continuously-suctioned partial suction zone and the plurality of partial suction zones forming an entire suction zone having a width in the web run direction and a length extending the width of the web.

35. The suction device according to claim 34, further comprising each of the plurality of partial suction zones being selectively isolatable from the vacuum.

36. The suction device according to claim 34, further comprising each of the plurality of suction openings being associated with a respective one of the plurality of partial suction zones.

* * * * *